US006634637B2

(12) United States Patent
Yoshida et al.

(10) Patent No.: US 6,634,637 B2
(45) Date of Patent: Oct. 21, 2003

(54) RETARD ROLLER AND SHEET FEEDER

(75) Inventors: Yuma Yoshida, Kasugai (JP); Yoshihiro Wago, Kani (JP); Yasuhiro Iwamoto, Toyohashi (JP); Hideki Sendo, Toyokawa (JP)

(73) Assignee: Tokai Rubber Industries, Ltd., Komaki (JP)

( * ) Notice: Subject to any disclaimer, the term of this patent is extended or adjusted under 35 U.S.C. 154(b) by 0 days.

(21) Appl. No.: 09/977,259

(22) Filed: Oct. 16, 2001

(65) Prior Publication Data

US 2002/0130460 A1 Sep. 19, 2002

(30) Foreign Application Priority Data

Oct. 16, 2000 (JP) ..... 2000-314660

(51) Int. Cl.[7] ..... B65H 3/52
(52) U.S. Cl. ..... 271/122; 271/121; 271/125
(58) Field of Search ..... 271/121, 125, 271/122

(56) References Cited

U.S. PATENT DOCUMENTS 6,450,494 B1 * 9/2002 Adema ..... 271/122

FOREIGN PATENT DOCUMENTS

| | | |
|---|---|---|
| JP | 05-221059 | 8/1993 |
| JP | 08-108591 | 4/1996 |
| JP | 11-193145 | 7/1999 |

* cited by examiner

*Primary Examiner*—Donald P. Walsh
*Assistant Examiner*—Kenneth W Bower
(74) *Attorney, Agent, or Firm*—Armstrong, Westerman & Hattori, Ltd.

(57) ABSTRACT

A retard roller of non-ground surface type which is virtually free from adhesion of paper dust thereby to have an excellent friction coefficient sustain ability, and which is free from creaky noises at a relatively low sheet feeding speed; a retard roller of non-ground surface type having little variation in outer diameter; and a sheet feeder employing such a retard roller. The retard roller comprises a roller body and a shaft extending axially therethrough, the roller body having a textured roller surface comprising a multiplicity of island portions (10) and a sea portion (11) recessed from the island portions, the island portions and the sea portion each having a multiplicity of fine projections (12). The ratio $S_1/S_2$ of the total area $S_1$ of the island portions to the area $S_2$ of the sea portion preferably is 0.25 to 0.55. The fine projections preferably each have a height of 3 to 25 $\mu$m.

12 Claims, 3 Drawing Sheets

RETARD ROLLER AND SHEET FEEDER

BACKGROUND OF THE INVENTION

1. Field of the Invention

The present invention relates to a sheet feeder for use in a copying machine, a facsimile machine, a printer or the like, and to a retard roller for use in such a sheet feeder.

2. Description of the Art

In sheet feeders for use in a copying machine, a facsimile machine and a printer, sheets from a sheet tray are fed into a sheet separator by a pickup roller where the sheets are separated from each other and fed out on a one-by-one basis. The sheet separator of the sheet feeder is generally provided with a multiple-sheet-feeding prevention mechanism of an FRR (Feed and Reverse Roller) type or an FR (Friction Retard) type so that the sheets assuredly can be separated from each other for the one-by-one sheet feeding.

In a sheet feeder having a multiple-sheet-feeding prevention mechanism of the FRR type, as shown in FIG. 5, a pickup roller 3 feeds a sheet 1 from a sheet tray 2 into a sheet separator. In the sheet separator, a retard roller 5 is disposed in abutment against a sheet feeding roller 4 provided with a torque limiter 6 to prevent multiple sheet feeding.

When a single sheet 1 is fed into the sheet separator in the sheet feeder, a frictional torque exerted on the retard roller 5 by the sheet feeding roller 4 rotating in a normal direction is greater than a threshold of the torque limiter 6. Therefore, the retard roller 5 also rotates in a normal direction to feed out the sheet 1. When two or more sheets 1 are fed into the sheet separator, on the other hand, the retard roller 5 is not influenced by the friction of the sheet feeding roller 4, and thus the friction torque does not reach the threshold of the torque limiter 6. Therefore, the retard roller 5 stops rotating, or rotates in a reverse direction, to stop movement of excess sheets, and only the uppermost sheet 1 is fed out in contact with the sheet feeding roller 4.

Exemplary materials used in the pickup roller 3, the sheet feeding roller 4 and the retard roller 5 in the sheet feeder are rubber materials including olefin rubbers such as EPDM, natural rubbers, polynorbornene rubbers, urethane rubbers, and urethane foams. These rollers are generally produced by: (1) cutting or forming a cylindrical roller body from a solid rubber material or urethane foam, inserting a shaft into the cylindrical roller body, and grinding the surface of the roller body; or (2) molding a cylindrical roller body around a metal shaft in a mold, and grinding the surface of the roller body.

When a higher reliability is required for the sheet feeding in the sheet feeder, the multiple-sheet-feeding prevention mechanism of FRR type is generally utilized which employs a retard roller in the sheet separator. The retard roller typically has a ground roller surface for preventing a reduction in the friction coefficient thereof due to aging. The ground roller surface is less liable to suffer from adhesion of foreign matter and paper dust generated during the sheet feeding, and maintains a sufficient friction coefficient during use. Further, the retard roller having a ground roller surface relatively easily satisfies dimensional accuracy requirements.

However, a conventional retard roller requires a grinding process in the production thereof, and the costs of this grinding process account for a high percentage of the production costs, thereby preventing cost reduction. Therefore, attempts have been conventionally made to develop a roller which requires no grinding process in production thereof. One example of such a roller is a roller having a textured roller surface similar to the ground roller surface as proposed in Japanese Unexamined Patent Publication Nos. 5-221059 (1993) and No. 8-108591 (1996).

However, the textured surface of this conventional roller which is brought into contact with a paper sheet is like a mirror surface, so that paper dust generated during the sheet feeding does not easily slip away, but rather is liable to adhere on the surface of the roller. This adhered dust makes it difficult for the roller to stably maintain a sufficient friction coefficient during prolonged use. Further, the roller has a relatively large mirror surface area. Therefore, when the roller is used as the retard roller, the roller is liable to suffer from a so-called stick-slip phenomenon which causes noises (creaky noises) at a relatively low sheet feeding speed (150 mm/sec or lower).

In the production of the conventional textured surface roller (the non-ground surface roller), an interior surface of a mold for formation of the textured surface is subjected to a shot blasting process or a chemical etching process. However, the shot blasting process fails to produce deep undulations on the interior surface of the mold, and the chemical etching process merely produces relatively smooth undulations (pseudo-mirror surface) on the interior surface of the mold. Therefore, the conventional textured surface roller has a difficulty in providing a performance comparable to the ground surface roller. When the conventional textured surface roller is employed as the retard roller, the roller suffers from a strain which occurs when the roller body is press-fitted around a resin or metal shaft in the production thereof and, hence, this type of roller has difficulty in satisfying requirements for the precision of the outer diameter and concentricity thereof.

Since the conventional textured surface roller fails to offer a retard roller performance comparable to the ground surface roller, the ground surface roller is currently employed as the retard roller.

In view of the foregoing, it is an object of the present invention to provide a less expensive retard roller of non-ground surface type which is virtually free from adhesion of paper dust generated during sheet feeding so as to have a long-term friction coefficient sustain ability comparable to the ground surface roller, and to be free from creaky noises at a relatively low sheet feeding speed. It is another object of the invention to provide a retard roller which is free from the influence of a strain which occurs when a roller body thereof is press-fitted around a shaft in the production thereof and, hence, the roller has an outer diameter and concentricity of improved accuracy.

It is further another object of the present invention to provide a sheet feeder which includes the aforesaid retard roller, and which is excellent in durability and free from creaky noises.

SUMMARY OF THE INVENTION

In accordance with a first aspect of the present invention to achieve the aforesaid objects, there is provided a retard roller for use in a sheet feeder, which comprises a roller body and a shaft extending axially through the roller body, the roller body having a textured roller surface comprising island portions and a sea portion recessed from the island portions, the island portions and the sea portion each having fine projections.

On the roller surface of the roller body of the inventive retard roller, the ratio $S_1/S_2$ of the total area $S_1$ of the island portions to the area $S_2$ of the sea portion is preferably 0.25 to 0.55. The fine projections on the island portions and the sea portion preferably each have a height of 3 to 25 $\mu$m. Further, the island portions on the roller surface preferably each have a height of not smaller than 10 $\mu$m, and are preferably spaced from each other by a peak-to-peak distance of not greater than 1.0 mm.

In the inventive retard roller, the shaft has an outer diameter progressively decreasing from one end to the other end thereof. One end of the shaft serves as an insertion end when a roller body material having a uniform outer diameter and a uniform inner diameter was press-fitted around the shaft during production of the roller.

In accordance with a second aspect of the present invention, there is provided a sheet feeder employing the aforesaid retard roller. In the inventive sheet feeder, the retard roller stops rotating or rotates in a reverse direction when a plurality of sheets are fed thereto.

DETAILED DESCRIPTION OF THE PREFERRED EMBODIMENTS

Figure 1:
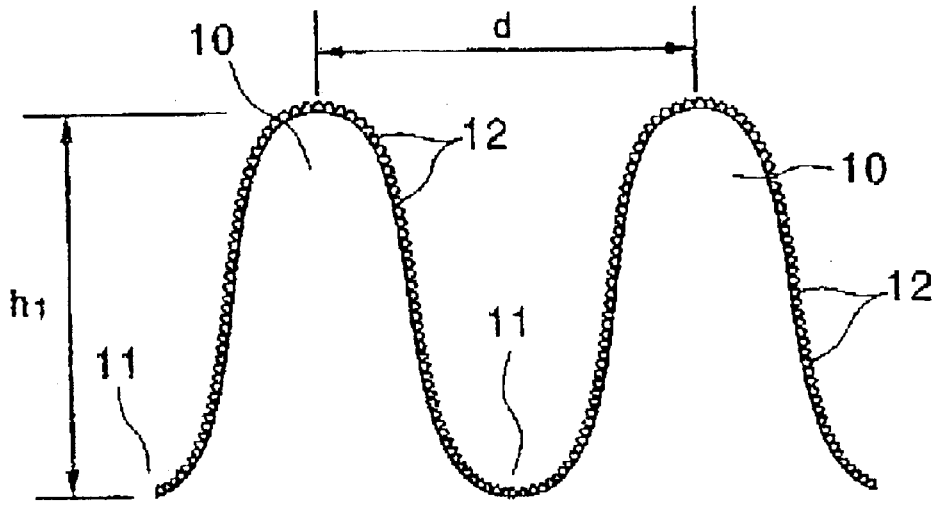
FIG. 1 is a sectional view schematically illustrating the surface configuration of a retard roller according to the present invention.
Figure 2:
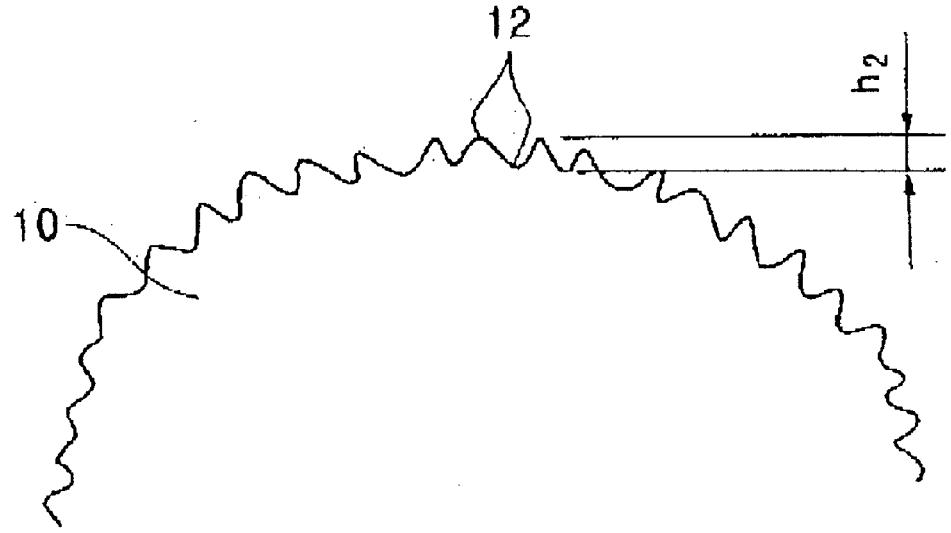
FIG. 2 is a sectional view schematically illustrating the surface of the retard roller of FIG. 1 on a larger scale.

As schematically illustrated in FIG. 1, a retard roller according to the present invention has a textured roller surface with a surface configuration which comprises a multiplicity of island portions 10 and a sea portion 11 recessed from the island portions 10. The island portions 10 and the sea portion 11 on the textured surface each have a multiplicity of fine projections 12. FIG. 2 illustrates a portion of an island portion 10 on the textured surface shown in FIG. 1 on a larger scale for easy understanding of the fine projections 12.

Figure 3:
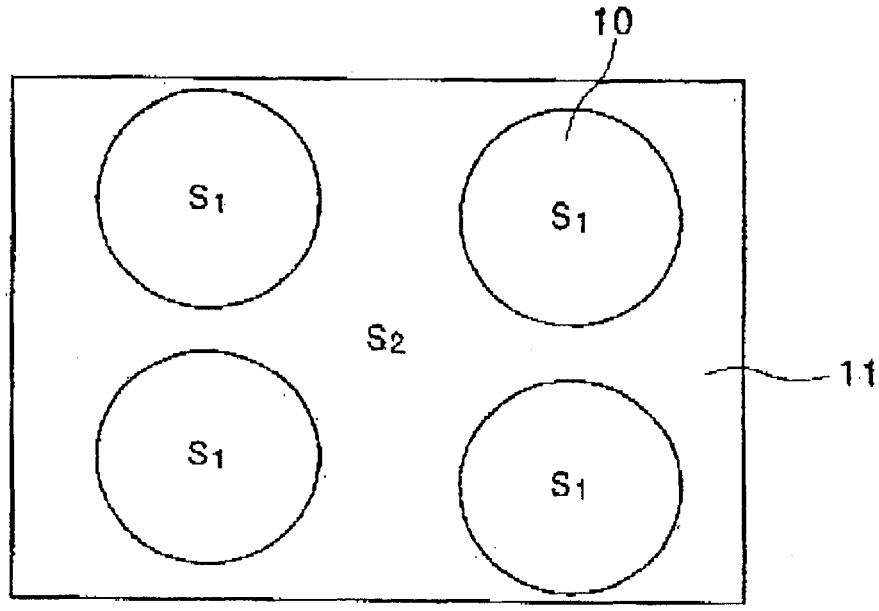
FIG. 3 is a schematic plan view for explaining the total area of island portions and the area of a sea portion on the surface of the retard roller of the invention.

In the inventive retard roller having the aforesaid surface configuration, and as shown in FIG. 3, the area ratio $S_1/S_2$ of the total area SI of the island portions 10 to the area $S_2$ of the sea portion 11 on the textured surface preferably should be $0.25 \leqq S_1/S_2 \leqq 0.55$. The total area $S_1$ of the island portions 10 and the area $S_2$ of the sea portion 11 are determined in the following manner. An ink or the like is applied onto the retard roller surface, and transferred from the roller surface onto a paper sheet with a load of 300 gf. Then, the total area of ink transferred portions on the paper sheet and also the area of a blank portion on the paper sheet are measured by means of an image processing apparatus, and defined as $S_1$ and $S_2$, respectively.

If the area ratio $S_1/S_2$ is smaller than 0.25, the resulting retard roller has a reduced total contact area with respect to a paper sheet and, hence, tends to have a smaller initial friction coefficient and thus a poorer rotation follow ability. Further, the retard roller is liable to suffer from uneven wear and to cause creaky noises at a relatively low sheet feeding speed. On the other hand, if the area ratio $S_1/S_2$ is greater than 0.55, the resulting retard roller has an increased total contact area with respect to a paper sheet and, hence, has a greater initial friction coefficient. Therefore, paper dust generated during the sheet feeding is less liable to slip away and thus is more liable to adhere on the roller surface, so that the roller tends to fail to maintain a sufficient friction coefficient. As a consequence, the roller initially provides a good sheet feeding performance, but its rotation follow ability gradually deteriorates. This result makes it impossible to ensure a stable sheet feeding performance during prolonged use.

Other requirements for the configuration of the roller surface are as follows. As shown in FIG. 2, the fine projections 12 preferably each have a height $h_2$ of 3 to 25 $\mu$m ($3\ \mu m \leqq h_2 \leqq 25\ \mu m$). If the height $h_2$ is smaller than 3 $\mu$m, the roller surface is like a mirror surface, so that paper dust is liable to adhere on the roller surface and thereby significantly reduce the friction coefficient of the roller. Further, the mirror-like roller surface is liable to cause the stick-slip phenomenon to cause creaky noises when operating at a relatively low sheet feeding speed. On the other hand, if the height $h_2$ is greater than 25 $\mu$m, the roller surface has an excessively large roughness and, hence, the resulting retard roller tends to have a smaller initial friction coefficient and thus a poorer rotation follow ability.

As shown in FIG. 1, the island portions 10 on the textured roller surface preferably each have a height $h_1$ of not smaller than 10 $\mu$m as measured from the bottom of the sea portion 11 to the peak of the island portion 10. If the height hi is smaller than 10 $\mu$m, the resulting roller cannot stably maintain a sufficient sheet feeding performance during prolonged use because the island portions 10 become worn down. Further, the island portions 10 are less liable to deform, so that the creaky noises cannot satisfactorily be prevented. Still further, the height hi is higher than the height $h_2$ ($h_1 > h_2$)

The island portions 10 are preferably spaced from each other by a peak-to-peak distance d of not greater than 1.0 mm. If the peak-to-peak distance d is greater than 1.0 mm, the resulting roller tends to have insufficient strength (block rigidity) and, hence, tends to have an insufficient wear resistance. In addition, with such a distance, the island portions 10 are more liable to deform, so that the resulting roller may fail to provide a stable sheet feeding performance.

The height $h^1$ and peak-to-peak distance d of the island portions 10 and the height $h_2$ of the fine projections 12 are determined by means of a surface roughness meter.

With the configuration of the roller surface properly structured as described above, the inventive retard roller has a friction coefficient sustain ability comparable to the conventional ground surface roller, because paper dust generated during the sheet feeding is less liable to adhere on the roller surface. Since the fine projections and the island portions on the roller surface can deform to absorb vibrations, the creaky noises can be prevented which are often observed in the case of the conventional ground surface retard roller generating at a relatively low sheet feeding speed (150 mm/sec or lower) By appropriate selection of the configuration of the roller surface, the initial friction coefficient of the roller can easily be set, and a reduction in friction coefficient during use can easily be estimated. Therefore, the roller can be designed more flexibly for various types of sheet feeders.

Next, an explanation will be given to a method of producing the inventive retard roller. In general, a cylindrical roller material is molded in a mold, and cut into a predetermined size for formation of a roller body. Then, the roller body is press-fitted around a shaft. Alternatively, a roller body may be molded around a shaft in a mold.

To impart the retard roller with the textured surface which comprises the island portions and the sea portion each having the fine projections as described previously, the interior surface of the mold used for the formation of the textured roller surface is subjected to an electric discharge machining. In this process, larger undulations which are complementary to the island portions and the sea portion are formed on the mold surface and, at the same time, smaller undulations which are complementary to the fine projections are formed on the larger undulations. Alternatively, the mold surface is subjected to an ordinary chemical etching process for formation of the larger undulations thereon, and then a shot blasting process is used for formation of the smaller undulations on the larger undulations.

Thus, with the above, there is no need to perform a grinding process for texturing the surface of the retard roller. Consequently, cost savings can be achieved by a reduction in machining costs. The retard roller, though having a non-ground surface, has surface properties comparable to the ordinary or conventional ground surface roller.

Usable as a material for the roller body of the inventive retard roller are rubber materials such as polyurethane, EPDM and polynorbornene rubbers, which are typically used for ordinary or conventional rollers. Particularly, a polyurethane material, e.g., a polyether polyurethane material, is desirably used, a material which is superior in wear resistance and weathering resistance so as to ensure stable properties for a long period of time.

The retard roller preferably has a hardness of 60 to 85°. The roller hardness is measured by means of a durometer of Type A, and herein is defined as a reading taken three seconds after the probe of the durometer is pressed against the roller surface.

Figure 4A:
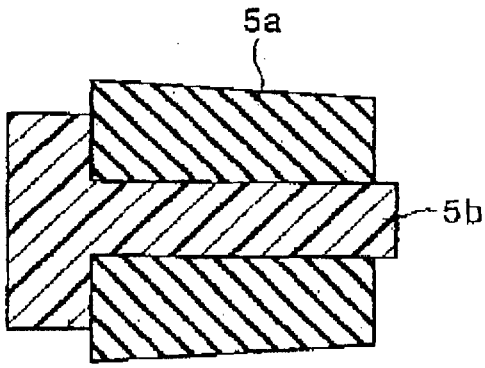
FIGS. 4(*a*) and 4(*b*) are schematic sectional views respectively illustrating a prior art retard roller having a variation in outer diameter and the inventive retard roller having no variation in outer diameter.
Figure 4:
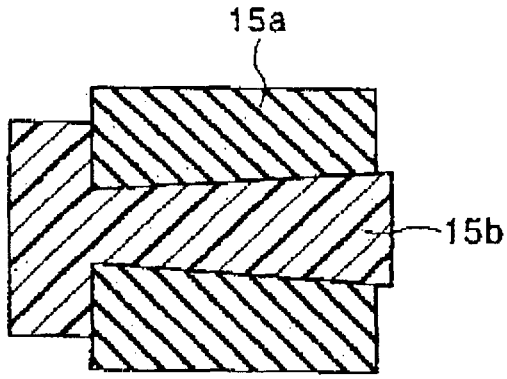

A conventional non-ground surface roller generally has a variation in outer diameter, i.e., the outer diameter of a roller body 5*a* progressively increases toward a flange of a shaft 5*b*, as shown in FIG. 4 (*a*), because a strain occurs in the roller body 5*a* when the roller body is press-fitted around the shaft 5*b* during the production thereof.

In the case of the inventive retard roller, as shown in FIG. 4(*b*), a shaft 15*b* has an outer diameter progressively decreasing from one end thereof (the end serving as an insertion end when a roller body 15*a* is press-fitted around the shaft 15*b*) to the other end thereof (the flange end opposite from the insertion end). The roller body 15*a* then is press-fitted around the shaft 15*b* having such an outer diameter variation. As a consequence, the resulting retard roller has little or no variation in outer diameter. The outer diameter variation of the shaft 15*b* is appropriately determined depending on the type of the rubber material used for the roller body and the wall thickness of the roller body.

Figure 5:
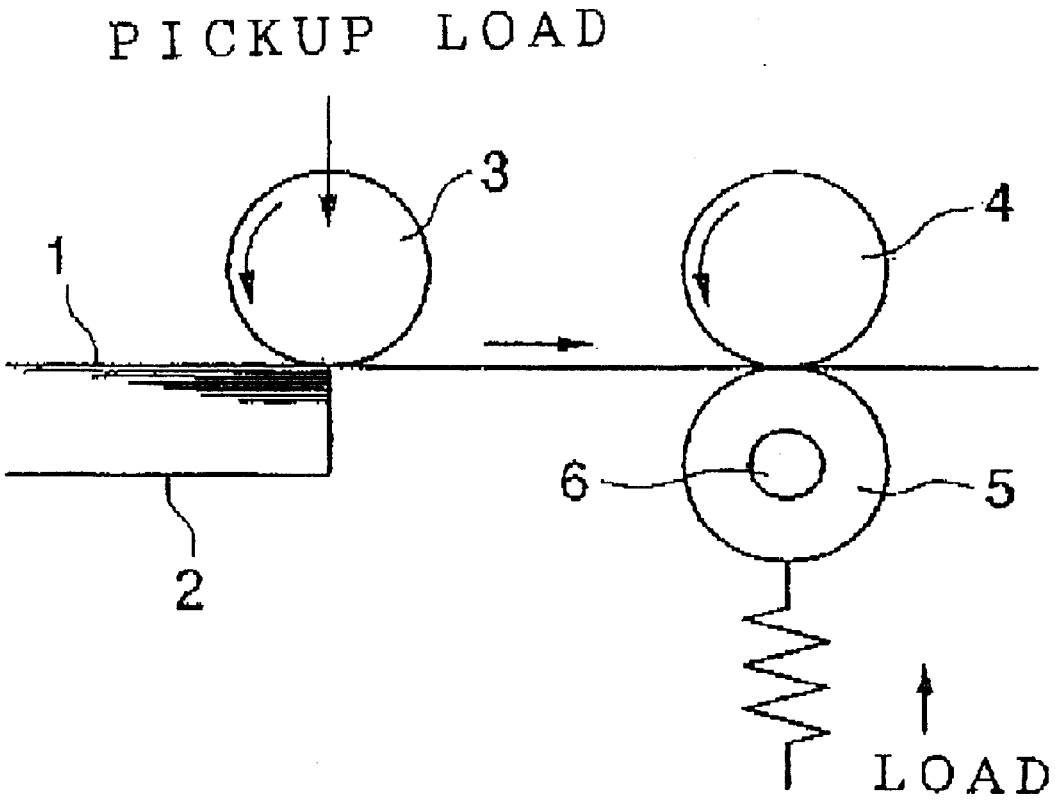
FIG. 5 is a side view schematically illustrating a sheet feeder.

The present invention further provides a sheet feeder which employs the aforesaid retard roller. The sheet feeder has substantially the same construction as the conventional sheet feeder as shown in FIG. 5. That is, the inventive sheet feeder includes a sheet separator of the FRR type, and the inventive retard roller is disposed in abutment against a sheet feeding roller in the sheet separator. The retard roller is provided with a torque limiter as is conventional, and biased against the sheet feeding roller with a predetermined load so as to stop rotating, or rotate in a reverse direction, when a plurality of sheets are fed thereto.

EMBODIMENTS

A urethane prepolymer was prepared from an ether polyol and an isocyanate. The urethane prepolymer was mixed with a glycol cross-linking agent, and the mixture was filled in a mold for molding a cylindrical roller body material of a urethane polymer. The roller body material was cut into a predetermined length for formation of a roller body. Then, the roller body was press-fitted around a resin shaft. Thus, a retard roller having a textured roller surface was produced without performing the grinding process.

It is noted that the interior surface of the mold was preliminarily subjected to an electric discharge machining so as to be imparted with a texture complementary to the textured roller surface of the retard roller. By employing molds having differently textured interior surfaces, retard rollers were produced which had differently textured roller surfaces, that is, having different island-to-sea area ratios $S_1/S_2$, different island peak-to-peak distances d, different island heights $h_1$ and different fine projection heights $h_2$. The area ratios $S_1/S_2$ were each determined by applying an ink on a roller surface, transferring the ink from the roller surface onto a paper sheet with a load of 300 gf, and measuring the total area of transferred ink portions on the paper sheet by means of an image processing apparatus (SPICCA II available from Japan Avionics Co., Ltd). The heights $h_1$ and $h_2$ and the distances d were each measured by means of a surface roughness meter SURFCOM 550A available form Tokyo Seimitsu Co., Ltd.

The retard rollers thus produced were each employed for production of a sheet feeder of the FRR type. In the sheet feeders, the retard rollers were each adapted to stop (i.e., rotate in neither a normal direction nor a reverse direction) when a plurality of sheets were fed thereto. With the use of the sheet feeders, an evaluation test was performed by continuously feeding paper sheets at a sheet feeding speed of 150 mm/sec. In the evaluation test, the friction coefficient of each of the retard rollers was measured initially and after 200,000 sheets were fed, and the rotation follow ability, wear resistance and generation of creaky noises were evaluated.

Retard rollers of Samples No. 1 to No. 6 having different area ratios $S_1/S_2$ are shown in Table 1, and retard rollers of Samples No. 7 to No. 12 having different fine projection heights $h_2$, etc. are shown in Table 2. In Tables 1 and 2, the evaluation results are indicated by ○ (good) Δ (intermediate), and X (bad)

TABLE 1

| Samples | 1 | 2 | 3 | 4 | 5 | 6 |
|---|---|---|---|---|---|---|
| Surface configuration of roller | | | | | | |
| $S_1/S_2$ | 0.15 | 0.2 | 0.25 | 0.4 | 0.55 | 0.6 |
| $h_2$ (μm) | 10 | 10 | 10 | 10 | 10 | 10 |
| d (mm) | 0.5 | 0.5 | 0.5 | 0.5 | 0.5 | 0.5 |
| $h_1$ (μm) | 50 | 50 | 50 | 50 | 50 | 50 |
| Friction coefficient μ | | | | | | |
| Initial | 1.1 | 1.2 | 1.3 | 1.4 | 1.4 | 1.5 |
| After 200k sheet feeding | 1.0 | 1.0 | 1.2 | 1.3 | 1.2 | 1.0 |
| Rotation followability | | | | | | |
| Initial | Δ | ○ | ○ | ○ | ○ | ○ |
| After 200k sheet feeding | Δ | Δ | ○ | ○ | ○ | Δ |
| Wear resistance | Δ | Δ | ○ | ○ | ○ | Δ |
| Creaky noises | Δ | Δ | ○ | ○ | ○ | ○ |

TABLE 2

| Samples | 7 | 8 | 9 | 10 | 11 | 12 |
|---|---|---|---|---|---|---|
| Surface configuration of roller | | | | | | |
| $S_1/S_2$ | 0.4 | 0.4 | 0.4 | 0.4 | 0.25 | 0.4 |
| $h_2$ ($\mu$m) | 1 | 3 | 25 | 30 | 10 | 3 |
| d (mm) | 0.5 | 0.5 | 0.5 | 0.5 | 1.0 | 0.5 |
| $h_1$ ($\mu$m) | 50 | 50 | 50 | 50 | 50 | 10 |
| Friction coefficient $\mu$ | | | | | | |
| Initial | 1.5 | 1.4 | 1.4 | 1.2 | 1.3 | 1.4 |
| After 200k sheet feeding | 0.9 | 1.2 | 1.2 | 1.1 | 1.1 | 1.2 |
| Rotation followability | | | | | | |
| Initial | ○ | ○ | ○ | ○ | ○ | ○ |
| After 200k sheet feeding | Δ | ○ | ○ | Δ | Δ | ○ |
| Wear resistance | ○ | ○ | ○ | ○ | Δ | Δ |
| Creaky noises | Δ | ○ | ○ | ○ | ○ | Δ |

For comparison, a retard roller (Sample No. 13) having a mirror-like roller surface, a retard roller (Sample No. 14) having a conventional ground surface, and a retard roller (Sample No. 15) having a conventional simple textured surface were employed for production of sheet feeders, and then the aforesaid evaluation tests were performed. The results are shown in Table 3.

TABLE 3

| Samples | 13 | 14 | 15 |
|---|---|---|---|
| Type of roller surface | Mirror | Ground (Prior art) | Textured (Prior art) |
| Surface configuration of roller | | | |
| $S_1/S_2$ | * | * | 0.4 |
| $h_2$ ($\mu$m) | * | * | ≦1 |
| d (mm) | * | * | 0.5 |
| $h_1$ ($\mu$m) | * | * | 50 |
| Friction coefficient $\mu$ | | | |
| Initial | 2.1 | 1.4 | 1.7 |
| After 200k sheet feeding | 0.7 | 1.2 | 0.7 |
| Rotation followability | | | |
| Initial | ○ | ○ | ○ |
| After 200k sheet feeding | x | ○ | x |
| Wear resistance | ○ | ○ | ○ |
| Creaky noises | x | x | Δ |

*: Impossible to measure

As can be understood from the above results, the retard rollers of Samples No. 3 to No. 5, No. 8 and No. 9 each having an area ratio $S_1/S_2$ of $0.25 \leqq S_1/S_2 \leqq 0.55$ and a fine projection height $h_2$ of $3\ \mu m \leqq h_2 \leqq 25\ \mu m$ each had a moderate initial friction coefficient, which was reduced to a smaller extent after the test, and each was excellent in rotation follow ability and wear resistance and was free from creaky noises.

However, the retard rollers of Samples No. 1 and No. 2 each having an area ratio $S_1/S_2$ of smaller than 0.25 each had a lower initial friction coefficient, and were poor in rotation follow ability and wear resistance. The retard roller of Sample No. 6 having an area ratio $S_1/S_2$ of greater than 0.55 had a higher initial friction coefficient, but was poor in friction coefficient sustain ability because paper dust generated during the sheet feeding was liable to adhere on the roller surface.

The retard roller of Sample No. 7 having a fine projection height $h_2$ of smaller than 3 $\mu$m, although satisfying the requirement for the area ratio $S_1/S_2$, had a mirror-like roller surface, so that the friction coefficient was reduced to a greater extent due to adhesion of paper dust and also creaky noises occurred. The retard roller of Sample No. 10 having a fine projection height $h_2$ of greater than 25 $\mu$m had a greater surface roughness and, hence, had a smaller initial friction coefficient and a poorer rotation follow ability.

A comparison between the retard rollers of Samples No. 3 and No. 11 having different island peak-to-peak distances d indicates that the rotation follow ability and wear resistance of the retard roller are deteriorated as the island peak-to-peak distanced increases. A comparison between the retard rollers of Samples No. 8 and No. 12 having different island height $h_1$ indicates that creaky noises are more liable to occur and the wear resistance is deteriorated as the island height $h_1$ decreases.

In the case of the retard roller of Sample No. 13 having the mirror-like roller surface and the retard roller of Sample No. 15 having the conventional textured surface, the friction coefficient was reduced to a greater extent, making it impossible to ensure a stable sheet feeding performance. The retard roller of Sample No. 14 having the ground roller surface suffered from the generation of considerable creaky noises.

According to the present invention, the retard roller is less expensive since there is no need for performing a grinding process in the production thereof, and is virtually free from adhesion of paper dust which thereby allows the roller to have a long-term friction coefficient sustain ability comparable to that of a conventional ground surface roller, and to be free from generating creaky noises when operating at a relatively low sheet feeding speed (150 mm/sec or lower).

The inventive retard roller is free from the influence of a strain which may occur when the roller body thereof is press-fitted around the shaft in production thereof and, hence, has an outer diameter and concentricity of improved accuracy.

According to the present invention, the sheet feeder which includes the inventive retard roller has an excellent durability, and is free from generating creaky noises during use.

What is claimed is:

1. A retard roller,for use in a sheet feeder, the retard roller comprising a roller body and a shaft extending axially through the roller body, the roller body having a textured roller surface comprising a multiplicity of island portions and a sea portion recessed from the island portions, the island portions and the sea portion each having a multiplicity of fine projections.

2. A sheet feeder comprising a retard roller as recited in claim 1.

3. A sheet feeder as set forth in claim 2, wherein the retard roller stops rotating or rotates in a reverse direction when a plurality of sheets are fed thereto.

4. A retard roller as set forth in claim 1, wherein a ratio $S_1/S_2$ of a total area $S_1$ of the island portions to an area $S_2$ of the sea portion on the roller surface is 0.25 to 0.55.

5. A sheet feeder comprising a retard roller as recited in claim 4.

6. A retard roller as set forth in claim 1, wherein the fine projections each have a height of 3 to 25 $\mu$m.

7. A sheet feeder comprising a retard roller as recited in claim 6.

8. A retard roller as set forth in claim 1, wherein the island portions on the roller surface each have a height of not smaller than 10 $\mu$m, and are spaced from each other by a peak-to-peak distance of not greater than 1.0 mm.

9. A sheet feeder comprising a retard roller as recited in claim 8.

10. A retard roller as set forth in claim 1, wherein the shaft has an outer diameter progressively decreasing from one end to the other end thereof, wherein a smaller end of the shaft serves as an insertion end when a cylindrical roller body material having a uniform outer diameter and a uniform inner diameter is press-fitted around the shaft during production of the roller.

11. A sheet feeder comprising a retard roller as recited in claim 10.

12. A sheet feeder having a sheet separator which comprises a sheet feeding roller, and a retard roller disposed in abutment against the sheet feeding roller and provided with a torque limiter, the retard roller comprising a roller body and a shaft extending axially through the roller body, the roller body having a textured roller surface comprising a multiplicity of island portions and a sea portion recessed from the island portions, the island portions and the sea portion each having a multiplicity of fine projections.

* * * * *